United States Patent [19]

Goldberg et al.

[11] 4,358,192

[45] Nov. 9, 1982

[54] APPARATUS AND METHOD FOR PROCESSING HEAT DEVELOPED PHOTOSENSITIVE RECORDING MATERIAL

[75] Inventors: Paul R. Goldberg, Palo Alto; Colin J. Doward, Los Altos, both of Calif.

[73] Assignee: Wavetek Indiana, Inc., Mountain View, Calif.

[21] Appl. No.: 177,880

[22] Filed: Aug. 14, 1980

[51] Int. Cl.[3] ..... G03D 7/00

[52] U.S. Cl. ..... 354/299; 354/300; 354/319; 219/388; 34/43; 346/110 R

[58] Field of Search ..... 354/297, 299, 300, 319; 219/216, 388; 34/43, 53, 155, 159; 355/27, 100; 346/110 R; 226/14, 113, 115, 117

[56] References Cited

U.S. PATENT DOCUMENTS

| | | | |
|---|---|---|---|
| 2,837,834 | 7/1958 | Alexeff et al. | 34/159 |
| 3,496,332 | 2/1970 | Lunde | 219/216 |
| 3,864,709 | 2/1975 | Bruns | 354/297 |
| 4,158,496 | 6/1979 | Cieplik | 355/27 |
| 4,275,959 | 6/1981 | Jones | 354/319 |

*Primary Examiner*—L. T. Hix
*Assistant Examiner*—Alan Mathews
*Attorney, Agent, or Firm*—Flehr, Hohbach, Test, Albritton & Herbert

[57] ABSTRACT

A processing system for heat developed photosensitive recording material or media is provided. This system processes the media with a minimum of waste of recording material. The media is processed at a fixed temperature and for a fixed period of time regardless of the speed at which the media passes through the processor. In one embodiment the system utilizes recirculating air to process the media. The heated air is captured in an oven configuration which employs the media itself as part of the air circulation path.

19 Claims, 2 Drawing Figures

APPARATUS AND METHOD FOR PROCESSING HEAT DEVELOPED PHOTOSENSITIVE RECORDING MATERIAL

This invention relates generally to an apparatus and method for processing a heat developed photosensitive recording media and more particularly to an apparatus and method providing fixed dwell time, fixed temperature processing.

The systems currently utilized to develop heat processed photosensitive materials, principally dry silver paper and film, employ temperature controlled heated platens. The exposed paper or film is placed in intimate contact with the heated platen and is allowed to develop for a prescribed period of time. In the situations in which the material is first exposed to light, severed from the supply roll and then heat processed as individual sheets, these systems adequately perform the processing function. A system of the type just described is shown and described in U.S. Pat. No. 3,864,709.

However, when a continuous record is required, as is the case of strip chart recorders, presently available heat platen systems have serious drawbacks. For a photosensitive material, which is exposed in a continuous manner, to be placed in contact with a heated platen for a prescribed period of time, it is necessary to use a platen of a specific length. The speed at which the media is entering the processing mechanism in conjunction with the length of time required for development, called dwell time, determines the platen length. If the material speed is increased, the platen would have to be commensurately elongated. This is not a practical solution. Some compensation for media speed changes can be achieved by altering the temperature of the heated platen. But, due to the thermal mass of the platen, this cannot take place immediately. Thus, a period of time must elapse between the initiation of the photosensitive platen media speed change and the actual occurrence thereof so that the temperature can be changed for development at the new speed. The final recording displays the highest quality and uniformity if it is processed at the prescribed temperature for the prescribed time. In the case of continuous strip chart recording, the full capabilities of the media are not realized using the presently available platen processing approaches.

A process designed to alleviate these problems for paper based materials only utilizes an opaque carbon backing as the heating element. In this process, electric current is passed through the carbon coating. By varying the amount of current flowing through the carbon backing, the development temperature can be altered almost instantaneously. Compensation for a wide range of paper speeds can thus be rapidly achieved. Although this method solves the problems associated with the thermal mass of the heated platen, it does not allow optimal paper development for it is not a fixed dwell time, fixed temperature system. In addition, it has the added disadvantage of wasting long lengths of paper. This is due to the fact that the current carrying electrodes must be separated by a distance which will allow the entire processing action to occur while the paper is between these electrodes. Since the development operation cannot proceed unless the backing is in contact with two longitudinally spaced electrodes, there is no way to cut the paper from the supply roll, feed it through the mechanism and continuously maintain the electrical connection from the leading edge of the paper to the trailing edge of the paper.

The ability to cut the photosensitive media before processing allows a platen system to operate with a minimum paper wastage, for once the material is cut it is unnecessary to feed an additional length of paper into the processor in order to allow the processed length of paper to exit from the machine. When it is not possible to cut the paper, as is the case with the carbon backed paper technique, the additional material trapped in the development apparatus must be discarded.

Accordingly, it is an object of the present invention to provide an improved method and apparatus for continuously processing heat developed photosensitive materials.

Another object of the present invention is to provide a unique processing system and method which overcomes the shortcomings associated with the previous development schemes.

In accordance with the present invention, there is provided a method and apparatus which employs a variable path length, fixed dwell time, fixed temperature processing system. In its preferred embodiment, the apparatus uses recirculated air in an enclosed structure to provide thermal energy to expose the media.

Reference to the following drawings and accompanying description will facilitate an understanding of the advantages and inherent functions of the present invention.

Figure 1:
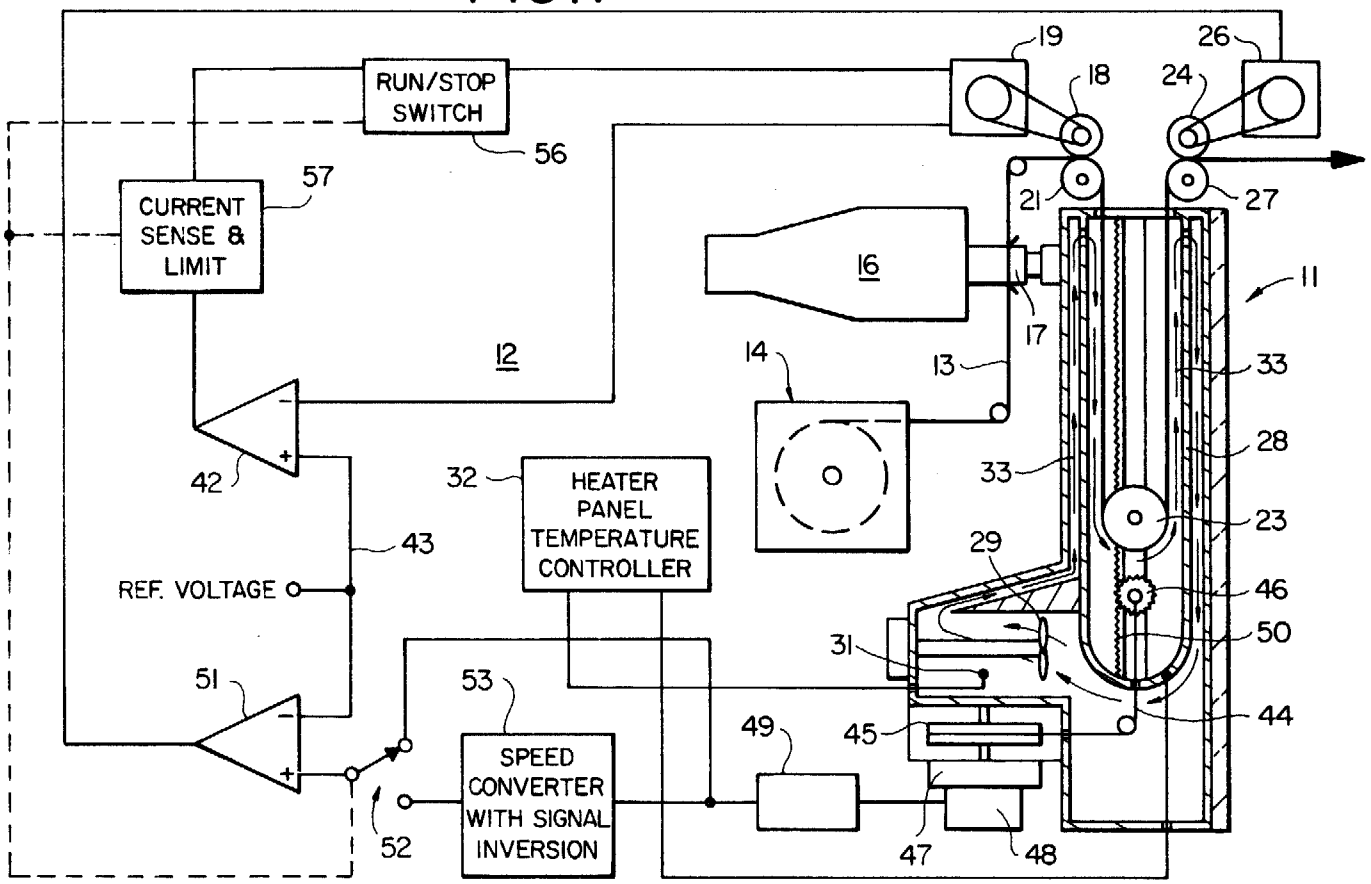
FIG. 1 is a sectional view of the apparatus of the present invention including a block diagram of the control circuits associated therewith which form the novel system of the present invention.

The system for developing or processing heat developed photosensitive film materials in accordance with the preferred embodiment of the present invention includes a developing apparatus 11 and a control circuit 12. This system is described for processing photosensitive media which is exposed by a fibreoptics cathode ray tube. It will become apparent that the system can be employed to process any material which is heat developed. The photosensitive media 13 is pulled from a media supply roll 14 and held in intimate contact with the face of a fibreoptics cathode ray tube schematically shown at 16 by a suitable means such as by a spring loaded pressure pad 17. The media is exposed by light from the fibreoptics cathode ray tube. The media, paper or film, is pulled or drawn past the fibreoptics cathode ray tube at a constant rate by a capstan 18 driven by drive motor 19. The media is held against the drive capstan 18 by pinch roller 21. As the paper leaves the capstan 18 and pinch roller 21, it is directed into a processing oven, to be described, over a spring loaded position sensing roller 23, and withdrawn from the processing oven by means of a capstan 24 driven by a motor 26 and acting against pinch roller 27. The media forms a loop in the processing oven. The oven includes a U-shaped elongated heater panel 28 and a motor driven hot air impeller 29. The exposed photosensitive media 13 is positioned as close as possible to the heater panel 28 without contacting the panel. This can be accomplished by proper size and position of the pinch rollers 21 and 27 and the sensing roller 23. In accordance with the invention, the output motor 26 is electronically controlled so that while the paper is being continuously exposed, its depth in the processing oven as measured by the position-sensitive roller 23 is controlled. The depth is selected as a function of the speed of the sensitive media through the oven whereby the length of time that the media is subject to exposure is controlled. That is, it is in the oven a fixed time regardless of the linear speed of the media 13 through the oven.

The temperature of the air within the oven is sensed by a sensor 31 whose output is applied to a heater panel temperature controller 32 os suitable design. The controller maintains the temperature of the heating panel 28. The hot air impeller 29 recirculates the air around an enclosed path defined by the processor oven walls, the heater panel and the photosensitive media. The flow path is generally indicated by the arrows 33. More particularly, the air is driven by the hot air impeller 29 and drawn past the air temperature sensor 31. The air flows upwardly between the housing and heating panel 28, downwardly and then upwardly between the air gap formed by the closely spaced media 13 and heater panel 28, and downwardly between the walls of the oven and the heater panel 28 and to the impeller for recirculation. During its travel the air is continuously heated by the heater panel. The air is efficiently heated because the heater panel is in intimate contact with the air as it flows upwardly and downwardly past both sides of the panel. Thus, all thermal energy which is extracted from the air to bring the exposed media to its proper development temperature is completely and efficiently replenished.

The speed of the input motor 19 is sensed by a motor speed sensor (not shown) which may comprise a shaft encoder which provides an output signal which is proportional to the motor speed and thus the linear speed of the photosensitive media as it is drawn past the fibreoptics cathode ray tube and fed into the developing apparatus 11. The speed proportional voltage is fed to one input of a motor speed comparison and drive amplifier 42. A second input to the amplifier 42 is a reference voltage applied along the line 43. The reference voltage determines the speed of the motor or media. This voltage is preset to correspond to the desired speed of the photosensitive media past the cathode ray tube. Under equilibrium conditions, the output of the motor speed comparison and drive amplifier 42 controls the electrical drive to the motor 19 so that the voltage from the motor sensor equals the reference voltage 43.

In order to establish a fixed development time independent of media speed, it is only necessary to establish the appropriate relationship between the linear media speed and the depth of the media in the processing oven. This is true because the depth to which the media reaches within the processing oven defines the length of time any given point on the media is in the oven for processing. For example, if the media is traveling at a linear rate of 100 millimeters per second with the position roller 23 at the depth of 150 millimeters, every point on the moving media will be processed for three seconds. If the linear speed is reduced by half to 50 millimeters per second and the position roller depth is reduced to 75 millimeters, the dwell time remains three seconds. By using the same reference signal and signals which vary proportionally to media linear speed and media depth, a fixed dwell time can be achieved automatically over a wide range of linear media speeds. The reference voltage 43 also serves as a media depth reference voltage.

The depth of the media 13 in the processing oven is sensed by sensing the position of the roller 23. The roller 23 is pulled downwardly toward the bottom of the developing chamber by a wire 44 which is wound onto a wire storage drum 45 attached to a roller 46 which acts along spaced racks 50 and is attached to roller 23 to cause it to uniformly move up and down in the oven. The wire storage drum includes a power spring 47 which maintains tension on the wire. A suitable shaft encoder 48 provides an output signal representative of the position of the roller 23. This signal is converted by a converter 49 and compared with the reference voltage 43 by the output motor speed comparator and drive amplifier 51. In their equilibrium positions the output from the drive amplifier 51 controls the drive motor 26 such that the exit speed of the medium from the processing oven causes position sense roller 23 to assume a depth that will force the voltage produced by the media depth converter to equal the media depth reference voltage 43. Since reference voltage 43 is also used to determine photosensitive media linear speed, the depth of the media in the oven will vary in direct proportion to the change in linear media speed and increase or decrease th output motor speed. In accordance with another feature of the present invention, when the photosensitive media is stopped, that is when its forward progression changes to zero millimeters per second, the media is completely removed from the processor mechanism to assure that an absolute minimum amount of material will be lost. This is accomplished by first stopping the motor 19 and allowing oven output motor 26 to continue until position sense roller 23 reaches a level above the processor oven. At this point the media is stretched between the input capstan-pinch roller 18, 21 and the output capstan-pinch roller 24, 27. This media plus the media between the face of fiberoptic cathode ray tube 16 and the input capstan-pinch roller combination 18, 21 will not be useable for subsequent recordings and therefore will be wasted. However, since the processing mechanism has been completely emptied, the total path the media must traverse before it exits the recording mechanism, the distance just delineated, can be made extremely short. This is in striking contrast to prior art continuous strip chart recording systems in which the media must pass through the entire length of the processing apparatus before it can exit the recording device. The media in the processing oven at the time oven input motor 19 is stopped must be withdrawn from the oven in such a manner that it too is processed for the required period of time. This is implemented by the use of the run-retract switch 52 and speed converter 53. As previously described, during equilibrium operation position sense roller 23 is kept at a constant depth by adjusting the speed of output motor 26 in accordance with the signal from output motor speed comparator and drive amplifier 51. This signal is proportional to the difference between media speed and depth reference voltage 43 and the voltage produced by media depth converter 49 driven by position sense roller 23. Thus, if the media depth should attempt to increase for any reason, other than a change in speed and depth reference voltage, output motor 26 will also increase in speed, pull up the roller and thus correct for the change. If the depth should attempt to decrease, the opposite action will take place, that is, output motor 26 will decrease in speed thus allowing position sense roller 23 in conjunction with spring 47 to pull the media back into a lower position.

At the instant the media entering the processor is stopped, by the action of run stop switch 56 or because of a paper jam at the end of the roll, position sense roller will begin to rise, for no new media is entering the processor and the output motor 26 is pulling the media out of the processor at the speed the media was, just an instant before, entering the processor. This decrease in media depth will be sensed by position sense roller 23 and begin to slow down output motor 26 in an effort to compensate for the change in depth. As a result, the media will not be retracted from the processor. Output motor 26 will slow to a stop in order to keep pace with the zero input rate of new media. To overcome this difficulty, run retract switch 52 is switched either in conjunction with run stop switch 56 or by the action of current sense and limit circuit 57. The latter senses the increase in input motor drive current when the paper jams at the end of a roll or for any other reason. At this point speed converter 53 is in series with the output signal from media depth converter 47. As media position sense roller 23 begins to rise speed converter 53 will process the decreasing media depth signal from depth converter 47 into a signal that is proportional to media position roller 23 upward velocity, the speed at which the media is exiting from the processor. This signal is compared against media speed and depth reference voltage 43 and thus causes output motor speed comparator and driver amplifier 51 to drive oven output motor 29 at the speed that oven input motor 26 was exhibiting just before it stopped. The media which has already entered the processing oven will therefore continue out of the oven at the same rate of speed it was going before oven input motor 19 halted. As a result, the exposed media will be developed for exactly the same length of time it would have been developed if input motor 19 had not been stopped and no under or over development takes place during the operation of retracting the media from the processing oven.

Figure 2:
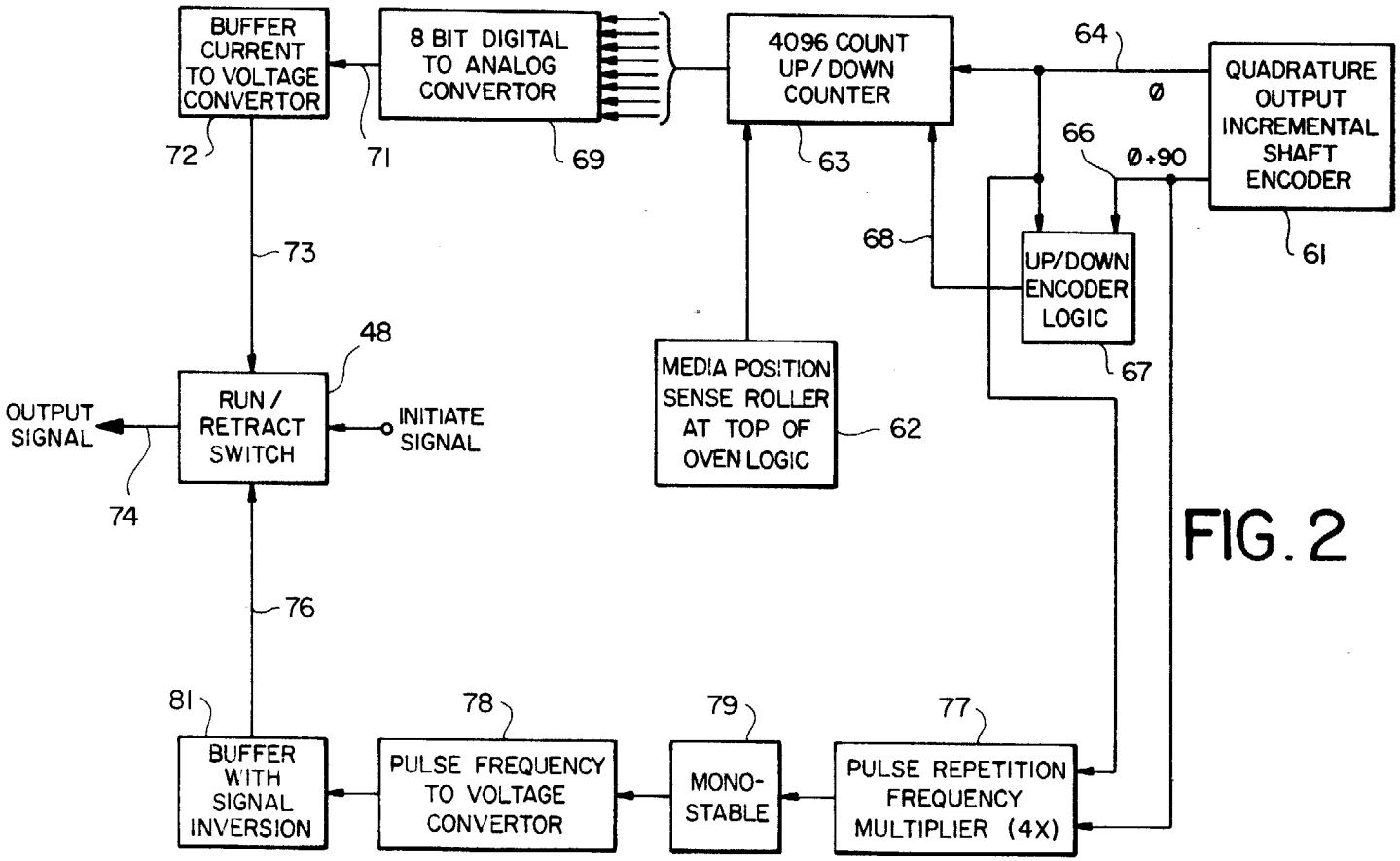
FIG. 2 is a more detailed block diagram of the speed converter shown in FIG. 1.

The speed converter and control system just described is shown in more detail in FIG. 2.

A quadrature output incremental shaft encoder 61 is included in the converter 48. The encoder may be a shaft encoder such as Disc Instrument Model No. EL 82-400-5. Incremental shaft encoder 61 rotates a predetermined number of revolutions as media position sense roller traverses from the uppermost portion to the lowest possible position within processor oven. In the preferred embodiment, shaft encoder 61 is a 400 pulse per rotation device and rotates 10.24 times for a 165.1 millimeter travel of media position sense roller 23. This means shaft encoder 61 produces 4096 pulses for every 165.1 millimeters of travel of position sense roller 23.

When position sense roller 23 is at the top of oven the structure logic 62 resets a 4096 count up/down counter 63 to zero. Counter 63 is electrically connected to shaft encoder 61 zero phase, output $\phi$ by means of phase $\phi$ line 64. The quadrature output signal, phase $\phi+90$, on line 66 from incremental shaft encoder 61, in conjunction with the phase $\phi$ signal on line 64 is used by up/-down decoder logic 67. Line 68 is connected to up/-down counter 63 and causes the up/down counter to count up or down depending upon the direction of travel media position roller 23. Thus, each time media position roller 23 moves from the top of processor oven toward the bottom counter 63 counts from zero to a maximum of 4096 counts. If media position roller 23 stops at 150 millimeters, depth counter 63 will be at count 3721. If it stops at 100 millimeters, depth counter 63 will have counted to 2480. Upon the reversal of direction media position roller 23, counter 63 will count in the opposite direction. Therefore, if media position roller 23 is at 100 millimeters depth, 2480 counts, and rises to 50 millimeters depth, counter 63 will count down from 2490 counts to 1240 counts. By resetting the counter to zero every time position roller 23 reaches the top of processor oven, it is assured that counter 63 always accurately tracks the position of media position roller.

Only the most significant bits from counter 63 are connected to 8 bit digital to analog converter 69. This configuration has been chosen because 8 bit (1 part in 256) resolution is sufficient for measuring media depth. But as will be described later, this is insufficient for the measurement of media retraction rate. Therefore, it is necessary that shaft encoder 61 produces 4096 counts for 165.1 millimeters of travel while only using every sixteenth count for the purpose of depth measurement. The preferred embodiment of the media depth and speed converter could employ a 12 bit digital converter in order to utilize the full depth resolution available from shaft encoder 61 and counter 63. However, in most applications the additional cost involved is not warranted.

Output line 71 from digital to analog converter 69 is connected to current to voltage converter 72 which also serves as a buffer and level translator. The output signal from buffer 72, on buffer output line 73, is directly proportional to the media depth within processing oven. During steady state operation run-retract switch 48 is in the "run" position and the signal on buffer output line 73 is routed through the switch to line 74 which, in turn, is connected to the positive input of output motor speed comparator and driver amplifier 51, FIG. 1.

While the photosensitive media is being retracted from the processing oven, run-retract switch 52 passes the media rate retraction signal, appearing on line 76 to line 74. This switch is activated by the action of run-stop switch 56, FIG. 1 or current sense and limit network 57 in FIG. 1. Quadrature signals, $\phi$ and $\phi+90$ from shaft encoder 61 are used to derive the media retraction rate signal. These signals, which appear on lines 64 and 66, respectively, are routed to pulse repetition frequency multiplier circuit 77 where their basic pulse repetition frequency is multiplied by a factor of four.

It is necessary to obtain the highest pulse frequency possible in order to allow accurate and repeatable conversion of pulse frequency to voltage. For example, as pointed out earlier, 3721 pulses are produced by shaft encoder 61 during its upward travel from a depth of 150 millimeters within the processor oven. It follows that from a 15 millimeter oven depth 372 pulses are produced and from a 1.5 millimeter oven depth 37 pulses are produced. These depths represent the distance in processor oven to which the media must progress to process media progressing at forward speeds of 100 millimeters per second, 10 millimeters per second and 1 millimeter per second for three seconds. If the media is moving through the processor oven at a given rate it must be retracted from processor oven at this same rate if uniform development is to be achieved. In the above example, the retraction time from processing oven would have to be three seconds if the forward velocity of the media is to remain a constant. Therefore, the pulse repetition frequencies, corresponding to these depths and forward media speeds during media retraction, would be 1240, 124 and 12.4. 12.4 pulses per second is an extremely slow rate and would cause the complexity of the pulse to voltage converter 78 to significantly increase in order to achieve the conflicting requirements of ripple free output signal and adequate response time. Thus, pulse repetition frequency multiplier 77 is included in the system to simplify the design of the pulse frequency to voltage converter.

The output of pulse repetition frequency multiplier 77 is connected to monostable 79 where pulses of varying width are converted to a constant width pulse train. These pulses are integrated by pulse to voltage converter 78 resulting in an essentially ripple free voltage, at the output of pulse to voltage converter 78, which is proportional to the speed at which the media is retracted from processing oven. Since this signal is directly proportional to the media retraction rate, it is connected to inverting buffer 81 before progressing to run-retract switch 48 and ultimately, during the retract operation, onto the positive terminal of output motor speed comparator and driver amplifier 46. This inversion is necessary because both the media depth signal and the media rate retraction signal are directly proportional to the physical quantities they represent but these physical quantities are corrected for by opposite actions. In the case of media depth, the depth is increased when output motor 26, FIG. 1, speed is decreased. In the case of the media retraction rate, the retraction rate is increased when output motor speed is increased.

Although the preferred embodiment of the invention employs recirculated hot air to process the exposed photosensitive material, the fixed processing dwell time development system presented can be implemented by mounting the heater panel 28 in such a manner as to force the media being processed against the panel as the media is drawn through the processing mechanism. That is, the position sensing wheel 23 can be increased in diameter and the input and output capstan pinch rollers 21 and 27 located such that the media 13 is in intimate contact with the heater panel 28. In this case the heater panel would serve as two heater platens, one for each side of the processing oven or bin. In other respects the system would work as just described in that the dwell time is controlled to provide the proper exposure to heat. The difference is in the manner in which the heat transfer from the platen to the media is implemented.

Thus, there has been provided an improved processing system for heat developed photosensitive media which utilizes in its preferred embodiment recirculated heated air as the processing means to develop an exposed media. The system controls the media in such a manner that it is developed for a fixed period of time with minimal material waste regardless of speed at which the material travels through the processing oven.

What is claimed is:

1. Apparatus for processing heat developed elongated photosensitive media comprising heating means;

means for moving the media through said heating means; and means responsive to the length of media in the heating means for controlling the media moving means whereby the media is exposed to the heating means a predetermined time regardless of speed of movement of the media through the heating means.

2. Apparatus as in claim 1 in which said means for moving the media through the heating means includes means for feeding the media to the heating means and means for removing the media from the heating means.

3. Apparatus as in claim 1 in which the heating means comprises an elongated oven and the media enters and exits the oven with a loop of the media formed in the oven.

4. Apparatus as in claim 1 in which said heating means comprises a heated platen and means for circulating air over said platen and in contact with the media.

5. Apparatus as in claim 3 in which said heating means comprises a U-shape heated platen with said loop of media depending into said U-shaped platen and means for circulating air between said platen and media.

6. Apparatus as in claim 5 including means for sensing the temperature of the circulated air and controlling the temperature of the heated platen to maintain a substantially constant air temperature.

7. Apparatus for processing heat developed media comprising an elongated insulated chamber, means for feeding the media to be developed into said chamber, means for withdrawing the media from the chamber and means for heating the media within the chamber to develop the same, and means for controlling the means for withdrawing the media from said chamber responsive to the position depth of the media in said chamber to thereby provide for a constant dwell time of the media in the chamber regardless of media input speed.

8. Apparatus as in claim 7 including means for generating a feed speed signal indicative of the speed of the media feeding means, means providing a reference signal and means responsive to the feed speed signal and the reference signal to control the speed of the media feeding means to maintain a constant feed rate determined by said reference signal.

9. Apparatus as in claim 7 in which said heating means comprises a U-shape heated platen with said loop of media depending into said U-shaped platen and means for circulating air between said platen and media.

10. Apparatus as in claim 9 including means for sensing the temperature of the circulated air and controlling the temperature of the heated platen to maintain a substantially constant air temperature.

11. Apparatus for processing heat developed media comprising an elongated insulated chamber having side walls, a U-shaped heated platen disposed within said chambers and spaced from the side walls, means for feeding the media to be developed into said chamber within said U-shaped heated platen, means for withdrawing the media from the chamber whereby said media forms a loop within the U-shaped heated platen, roller means within said chamber and serving to engage the loop and maintain the media under predetermined tension means associated with said roller means for providing an output signal indicative of the position of the roller and loop in the chamber, means responsive to said loop position signal to control the means for withdrawing the media from the chamber to thereby maintain a constant dwell time for the media within the chamber.

12. Apparatus as in claim 11 including means for circulating air between said platen and walls and between said platen and media.

13. Apparatus as in claim 12 including means for sensing the temperature of the circulated air and controlling the temperature of the heated platen to maintain a substantially constant air temperature.

14. Apparatus as in claim 12 including means for generating a feed speed signal indicative of the speed of the media feeding means, means providing a reference signal and means responsive to the feed speed signal and the reference signal to control the speed of the media feeding means to maintain a constant feed rate determined by said reference signal.

15. Apparatus as in claim 11 including means for guiding said roller.

16. Apparatus for processing developed photosensitive media comprising:

heating means including an elongated oven into which the media enters and exits with a loop of the media formed in the oven;

means for moving the media through the heating means;

loop position sensing means providing a signal indicative of the depth of the loop in the oven; and means for controlling the media moving means responsive to said signal to control the depth of the media in the oven whereby the media is exposed to the heating means a predetermined time regardless of speed of movement of the media.

17. Apparatus for processing heat developed photosensitive media comprising;

heating means;

means for moving the media through said heating means including means for feeding the media to the heating means and means for removing the media from the heating means;

means for generating a feed speed signal indicative of the speed of the media feeding means;

means providing a reference signal, means responsive to the feed speed signal and the reference signal to control the speed of the media feeding means to maintain a constant feed rate determined by said reference signal; and means for controlling the media moving means whereby the media is exposed to the heating means a predetermined time regardless of the speed of movement of the media.

18. Apparatus for processing heat developed photosensitive media comprising:

heating means comprising an elongated oven with a U-shaped heated platen into which the media enters and exits with a loop of the media depending into the platen;

means for circulating air between the platen and media;

loop position sensing means providing a signal indicative of the depth of the loop in the oven;

means for moving the media through said heating means;

means responsive to said signal for controlling the media moving means to control the depth of the media in the oven whereby the media is exposed to the heating means a predetermined time regardless of speed of movement of the media.

19. Apparatus as in claim 10 including means responsive to a signal representative of the speed of the feeding means and a reference signal for controlling the media feeding means to maintain a constant media feed rate.

* * * * *